United States Patent [19]

Hosoda et al.

[11] 3,945,166

[45] Mar. 23, 1976

[54] ROOF PLATE ASSEMBLY

[75] Inventors: Kiyoshi Hosoda, Kamifukuoka; Teruo Yamauchi; Masaru Kobayashi, both of Sagamihara, all of Japan

[73] Assignee: Suzuki Motor Company, Ltd., Japan

[22] Filed: June 3, 1974

[21] Appl. No.: 475,878

[52] U.S. Cl. ..... 52/520; 52/545; 52/547

[51] Int. Cl.[2] ..... E04D 1/34

[58] Field of Search ..... 52/520, 545, 547

[56] References Cited

UNITED STATES PATENTS

| | | | |
|---|---|---|---|
| 403,844 | 5/1889 | Kanneberg | 52/520 |
| 3,347,009 | 10/1967 | Meddick | 52/545 |
| 3,703,062 | 11/1972 | McKinney | 52/545 |
| 3,738,076 | 6/1973 | Kessler | 52/545 X |

*Primary Examiner*—Alfred C. Perham
*Attorney, Agent, or Firm*—Wigman & Cohen

[57] ABSTRACT

This disclosure relates to a roof plate assembly comprising a plurality of individual roof plates interlocked with one another by means of a plurality of anchoring pieces, and fastened to a batten or the like. The anchoring pieces connect the trailing end of each roof plate with the leading end of the following roof plate. The anchoring pieces and the roof plates are interlocked with one another by means of bent stop portions having portions spaced from one another with sufficient clearance to absorb dimensional inaccuracies during assembly. Each roof plate further includes a suspending piece which depends from its leading end and abuts the trailing end of the preceding roof plate to provide, in combination with the anchoring piece, a double connection at the trailing end of each roof plate.

4 Claims, 7 Drawing Figures

ROOF PLATE ASSEMBLY

BACKGROUND OF THE INVENTION

In the conventional assembly of roof plates, each roof plate was connected directly to the other and, accordingly, in the course of roof plate assembly the manufacturing errors in each roof plate and inaccurate clearances at the joints are accumulated into a considerable amount that often made the very connection of the roof plates difficult if not actually impossible within a predetermined area.

The present invention provides a method of assembling the roof plates by means of interlocking each roof plate on its front and rear end with anchoring pieces for eliminating the aforesaid inaccuracies by absorbing the aforesaid errors between the anchoring piece and each roof plate, and further by excluding the constructional dependency between the preceding roof plate and the following one.

DESCRIPTION OF THE INVENTION

The present invention relates to an assembled construction of roof plates made of metallic plate material which is of simple construction and lends itself to be applied in an easy manner.

The assembled construction of roof plates which has been on the market is so constructed that the roof plates are jointed between them and accordingly, in the course of roof plate assembly, the manufacturing errors in the roof plates and inaccurate clearances at the joints are accumulated into a considerable amount that often made connection of the roof plates difficult if not actually impossible within a predetermined area.

The assembled construction of the roof plate assembly in accordance with the invention permits an improved method of assembly by eliminating the aforementioned errors. The practical examples embodying the present invention shall be described in detail with attached drawings in the following:

Figure 1:
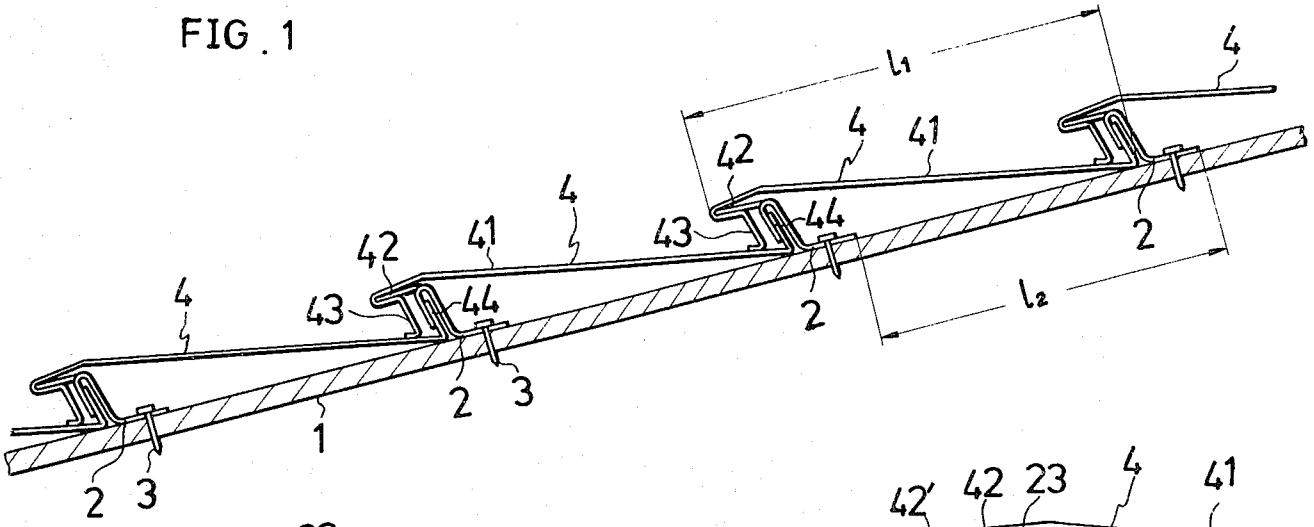
FIG. 1 depicts the first embodiment of the invention.
Figure 2:
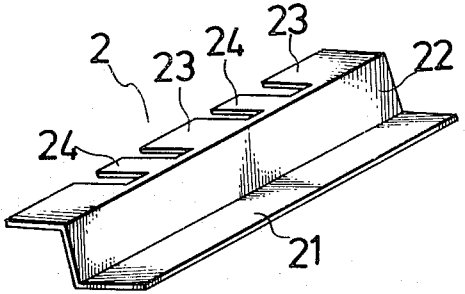
FIG. 2 depicts a detailed view of an anchoring piece to be used with the first embodiment.

In FIG. 1, 1 represents a batten and 2 an anchoring piece fixed at a proper distance on the batten with nails 3. 4 represents a roof plate. Each roof plate 4 includes a leading end and a trailing end. In the roof plate 41 represents a main part, 42 a collector edge located at the front or leading end of the main part 41 bent back upon itself through an acute angle thereby defining an internal recess, 43 a suspending piece, 44 a upright piece formed at the rear or trailing end of the main part 41 by bending. Further, the anchoring piece 2, as represented in FIG. 2, is a rectangular plate material bent in approximately ⌝-shape, forming the clamp 21 which fixes the aforesaid bent piece on the batten and the upright piece 22 and at the same time, the other piece is provided with a proper number of rectangular notches forming inserting pieces 23 and stop pieces 24 available easily for bending. By means of this construction, each roof plate 4 is stopped on its front end in such a manner that the inserting piece 23 of the anchoring piece 2 is inserted in the internal recess of the collector edge 42 of each roof plate and at the same time, its rear part is stopped by holding the upright piece 44 of the roof plate proper from above and by bending the stop piece 24 of the anchor piece 2. Moreover, a double connection is provided at the trailing end of each roof plate by means of the suspending piece 43 which extends downwardly from the adjacently-coupled roof plate in abutting relation therewith. The roofing operation is completed by jointing the roof plates 4 consecutively in this manner with the anchoring piece 2.

Figure 3:
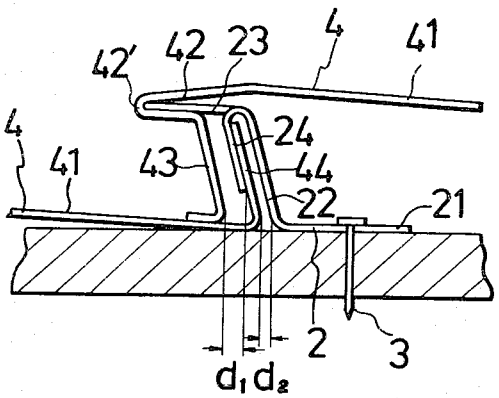
FIG. 3 depicts a detailed view of a joint of the first embodiment.

As should be apparent from the foregoing, when the roof plate assembly is constructed in accordance with this invention, each roof plate 4 is secured and fixed on both its leading and trailing ends by the anchoring pieces 2, and there is no fixed relationship between adjacent roof plates, except within a given tolerance range, as will become hereinafter apparent. As seen in FIG. 3, when the roof plates 4 are assembled with the front ends of the inserting pieces 23 engaging the bent points 42′ of the collector edge 42, a proper clearance $d_1$ is established between the suspending piece 43 of a roof plate 4 and the upright portion 44 of the preceding roof plate 4. Additionally, a proper clearance $d_2$ is established between the upright portion 44 and the upright piece 22 of the anchoring piece 2. Consequently, even if the length $l_1$ (FIG. 1) of the roof plate 4 and the distance $l_2$ between consecutive clamp pieces 2 are not precisely equal, the aforementioned clearances $d_1$ and $d_2$ absorb the dimensional inaccuracies thereby eliminating difficulties in roof laying caused by the accumulation of these inaccuracies as was the case with conventional roof assemblies. It should be apparent, therefore, that the instant invention renders a roof laying assembly markedly easier than prior art assemblies, while additionally providing a pleasing geometrical appearance.

Figure 4:
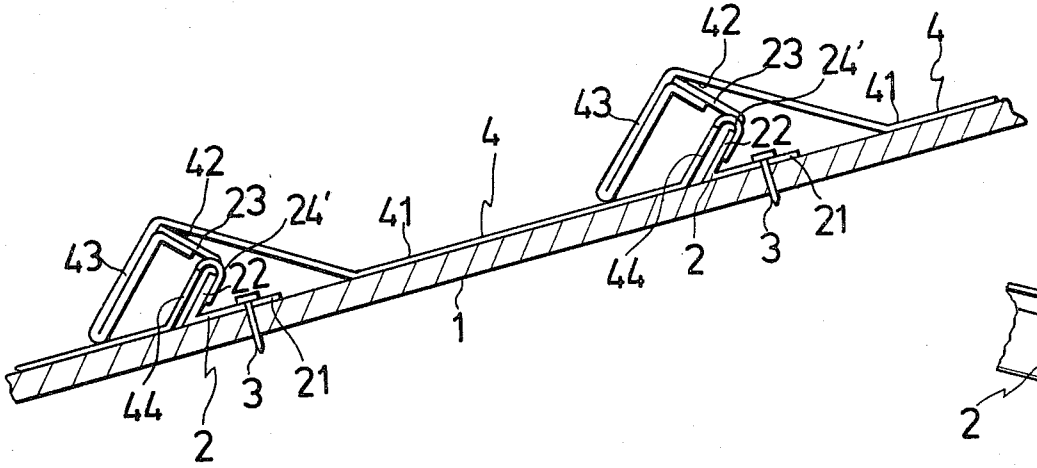
FIG. 4 depicts a second embodiment of the invention.
Figure 5:
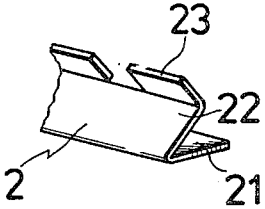
FIG. 5 depicts a detailed view of an anchoring piece to be used with the second embodiment.

FIG. 4 and FIG. 5 represent the second embodiment of the present invention. In this example, the stop piece 24 of the anchoring piece 2 of the first embodiment is eliminated and it is replaced by the construction that a stop 24′ available to be bent is installed in the front end of the upright piece of the roof plate 4 and this piece is bent to grasp the upright piece 22 of the anchoring piece 2 over its top edge.

Figure 6:
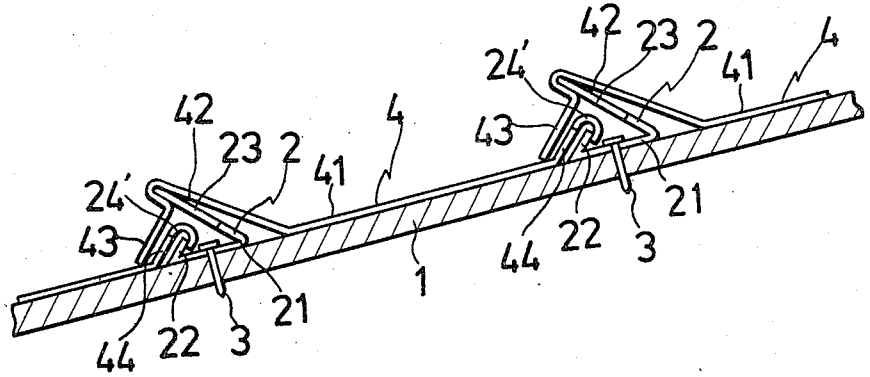
FIG. 6 depicts a third embodiment of the invention.
Figure 7:
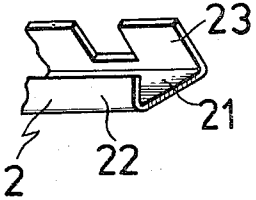
FIG. 7 depicts a detailed view of an anchoring piece to be used with the third embodiment.

Further, FIG. 6 and FIG. 7 represent the third embodiment of the present invention. In this embodiment the inserting piece 23 of the clamp piece 2 employed in the aforesaid second embodiment is formed on the opposite end of the clamp piece 21 of anchoring piece 2, that is to say, the upright piece and inserting piece are arranged on both sides of the clamp piece 21. It is obvious that by this construction, a similar result can be obtained as with the aforesaid first embodiment.

As described in detail above, in this invention, the roof plate 4, provided with the collector edge 42 and suspending piece 43 in the front and the upright piece 44 in the rear, and the anchoring piece 2, provided with the upright piece 22 and inserting piece 23 which is mated with the collector edge 42 of the roof plate 4, are installed and the upright piece 22 of the aforesaid anchoring piece 2 and the upright piece 44 of the aforesaid roof plate proper 4 are provided with the stop piece 24 or 24′. Consequently, as mentioned above, the detrimental effect caused by the manufacturing errors and similar inaccuracies is eliminated and easier assembly results. Moreover strict tolerances during manufacturing of the roof plates becomes unnecessary, thus enabling a mass production at lower costs. After completion of roofing operations, nails and other external fixing elements are all covered and, consequently, no corroding effects are caused on the exposed parts, providing long lasting and admirable appearance to the roof.

In accordance with the provisions of the patent statutes, we have herein described the principle of the invention, together with element which we now consider the best embodiments thereof, but we desire to have it understood that the structure disclosed is only illustrative and the invention can be carried out by other means.

Also, while it is designed to use the various features and elements in the conditions and relations described, some of these may be altered and modified without interfering with the more general results outlined.

Having thus described our invention, we claim:

1. A roof plate assembly comprising a plurality of individual roof plates interlocked with one another and fastened to a batten or the like, each of said roof plates having a leading end and a trailing end, said leading end being folded back upon itself to form a collector edge having an internal recess, a suspending piece extending from said collector edge and abutting the trailing end of an adjacent roof plate, said trailing end having an upright portion extending generally parallel to said suspending piece of the adjacent roof plate, and an anchoring piece for interlocking said leading end of each of said roof plates with said trailing end of the adjacent roof plate, said anchoring piece including a clamp portion adapted to be fastened to the batten, an insertion portion received within said internal recess of said collector edge, and means for interlocking said anchoring piece with said upright portion of said trailing end, whereby there is provided a double connection at the trailing end of each roof plate by means of both said interlocking means and said suspending piece which extends in abutting relation from the leading end of the adjacent roof plate interlocked therewith.

2. A roof plate assembly as defined in claim 1, wherein said anchoring piece includes an upright piece which extends generally parallel to said upright portion of said trailing end, and wherein said interlocking means includes a stop portion of said anchoring piece bent around said upright portion of said trailing end, said bent stop portion being spaced from said upright piece sufficiently to receive said upright portion therebetween while leaving sufficient clearance to absorb dimensional inaccuracies during assembly.

3. A roof plate assembly as defined in claim 1, wherein said anchoring piece includes an upright piece which extends generally parallel to said upright portion of said trailing end, and wherein said insertion portion of said anchoring piece extends from one edge of said upright piece and said clamp portion extends from another edge thereof.

4. A roof plate assembly as defined in claim 1, wherein said anchoring piece includes an upright piece which extends generally parallel to said upright portion of said trailing end, and wherein said interlocking means includes a stop portion of said upright portion bent around said upright piece of said anchoring piece, said bent stop portion being spaced from said upright portion sufficiently to receive said upright piece of said anchoring piece therebetween while leaving sufficient clearance to absorb dimensional inaccuracies during assembly.

* * * * *